US005699664A

United States Patent [19]

LaFleur

[11] Patent Number: 5,699,664

[45] Date of Patent: Dec. 23, 1997

[54] SHUT-OFF VALVE UNIT FOR A CIRCUIT FOR INJECTING AIR IN THE EXHAUST SYSTEM OF AN INTERNAL COMBUSTION ENGINE

[75] Inventor: Bernard LaFleur, Volvic, France

[73] Assignee: SAGEM SA, Paris, France

[21] Appl. No.: 559,387

[22] Filed: Nov. 15, 1995

[30] Foreign Application Priority Data

Nov. 17, 1994 [FR] France ..... 94 13757

[51] Int. Cl.[6] ..... F01N 3/10

[52] U.S. Cl. ..... 60/307; 137/455; 251/61.4

[58] Field of Search ..... 60/307; 137/614.2; 251/61.4

[56] References Cited

U.S. PATENT DOCUMENTS

| | | | |
|---|---|---|---|
| 3,748,855 | 7/1973 | Day | 60/290 |
| 3,905,193 | 9/1975 | Heilman et al. | 60/290 |
| 3,924,408 | 12/1975 | Beiswenger et al. | 60/290 |
| 4,070,830 | 1/1978 | Beiswenger | 60/290 |
| 4,141,214 | 2/1979 | Mitsuda et al. | 60/276 |

FOREIGN PATENT DOCUMENTS

| | | |
|---|---|---|
| 0 496 497A1 | 7/1992 | European Pat. Off. . |
| 2674288 | 9/1992 | France . |

*Primary Examiner*—John T. Kwon
*Attorney, Agent, or Firm*—Quarles & Brady

[57] ABSTRACT

A shut-off valve unit for a circuit for injecting air into an exhaust system of an internal combustion engine has a casing (9, 29) with a first chamber (10), a second chamber (24) and a third chamber (27). The valve rod (18) forms a passage (43) for communicating air between the first chamber (10) and the second chamber (24). The opening and closing of valve (19) with respect to valve seat (21) is controlled by movement of the membrane (12); which also controls communication between the second chamber (24) and the third chamber (27).

10 Claims, 3 Drawing Sheets

Figure 1:
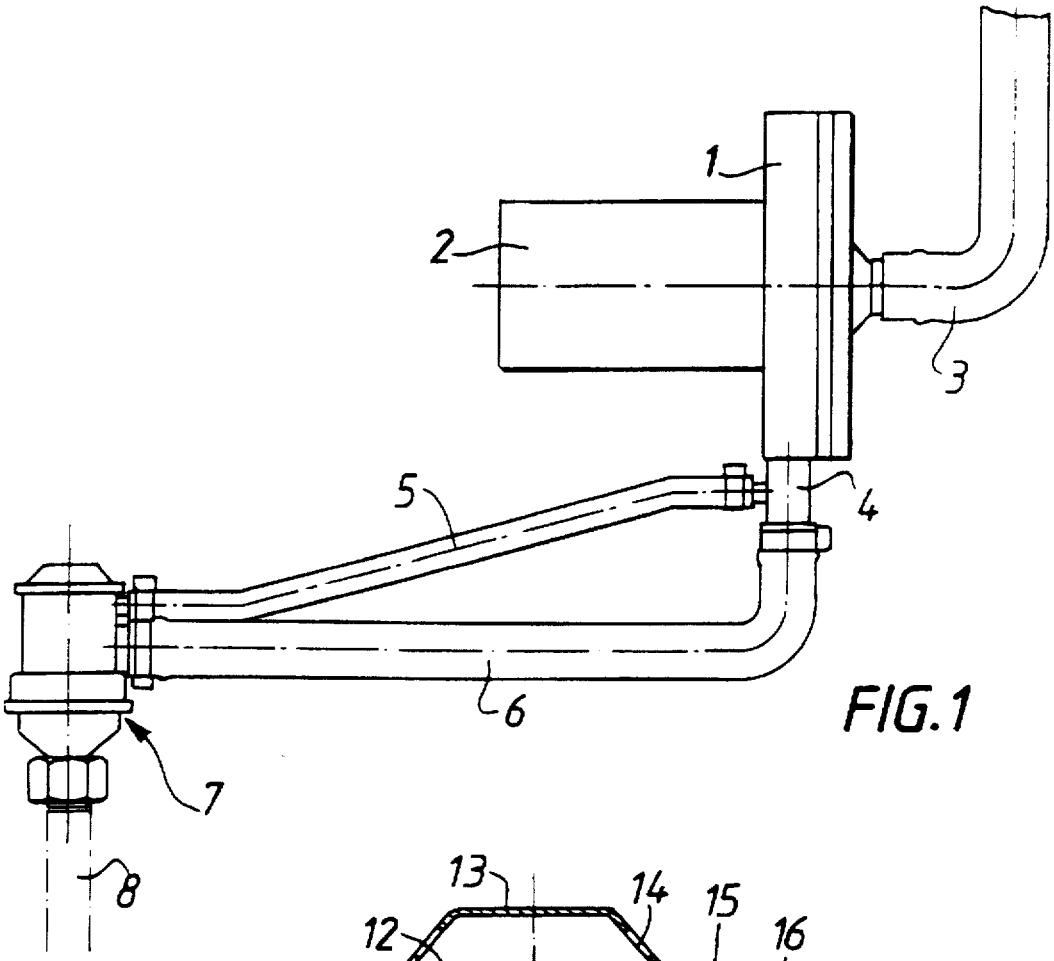

SHUT-OFF VALVE UNIT FOR A CIRCUIT FOR INJECTING AIR IN THE EXHAUST SYSTEM OF AN INTERNAL COMBUSTION ENGINE

The present invention concerns a shut-off valve unit for a circuit for injecting air in the exhaust system of an internal combustion engine.

Such circuits are already known, their function being to take external fresh air and inject it into the exhaust manifold of the engine, immediately adjacent to the exhaust valves. The temperature of the exhaust gases being very high, the non-burned residue hydrocarbons are reignited, leading to a lower level of pollution.

The injection of air in the exhaust system has another function. It is known that the use of catalytic converters is becoming increasingly widespread, and that a catalytic converters is only effective once it has reached a certain temperature. In view of the average length of an automobile journey, a large part of the distance travelled in these vehicles takes place with a cold, and therefore ineffective, catalytic converter. It has therefore been proposed to inject into the cylinders a mixture which is deliberately too rich, and then to inject fresh air into the exhaust manifold in order to bring about a sort of 'post-combustion', sharply increasing the temperature of the exhaust gases and so rapidly heating the catalytic converter. Of course this introduction of a mixture which is deliberately too rich and this injection of air in the exhaust system only last for the period required for the catalytic converter to heat up.

Until now, this function of injecting air in the exhaust system was accomplished by means of an air pump taking external fresh air, either via an independent air filter or via the engine's air inlet filter, and sending this air into the exhaust manifold via a shut-off valve and a check valve. The shut-off valve was designed to close the circuit when the pump was not operational, and the check valve was designed to prevent the exhaust gases from being sent back into the circuit when the oscillating pressure in the exhaust manifold exceeded the delivery pressure in the pump. The shut-off valve itself was a diaphragm valve controlled by a solenoid valve taking its negative pressure from the inlet manifold downstream from the butterfly valve. The solenoid valve was itself controlled via the same electric relay controlling the functioning of the air pump.

Such a circuit was therefore extremely complex and so both costly and prone to breakdowns.

The present invention is designed to overcome these disadvantages.

To this end, the object of the invention is a shut-off valve unit for a circuit for injecting air in the exhaust system of an internal combustion engine, characterised by its comprising:

- a casing;
- a membrane delimiting a first chamber in the said casing;
- means for admitting air into the said first chamber from an air pump;
- second chamber in the said casing;
- means for admitting air into the said second chamber from the said air pump;
- a third chamber in the said casing;
- means for evacuating air from the said third chamber towards the exhaust manifold of the engine; and
- a valve controlled by the said membrane to allow communication between the said second and third chambers when the air pump is in operation.

Thus the shut-off valve according to the invention, when compared to that of prior art, has the advantage of depending only on the air injection pump. It is in fact directly controlled by the delivery pressure of this pump, and not by the negative pressure prevailing in the inlet manifold via a solenoid valve, itself requiring an electricity supply. There results a greatly improved level of simplicity and so a lower cost and smaller risks of breakdown for the circuit for injecting air in the exhaust system.

In a first embodiment, the said means for admitting air into the first chamber include a passage formed between the first and second chambers.

In this case, a single duct connects the air pump to the valve of the invention.

More especially, the said first and second chambers may be adjacent and separated by a wall, the said passage being comprised of an aperture formed in the said wall.

The said passage may equally be formed in the valve rod.

In this case, the passage may issue axially into the first chamber, its aperture being, at rest, plugged by a plugging element, such as a second membrane, acted upon by a spring.

The first membrane referred to may be acted upon by a spring on its opposite face to that facing the said first chamber.

More especially, the said first chamber may be connected to the said third chamber by an exhaust duct, formal for example within the wall of the casing, upon which may be fitted a calibrated check valve.

In another embodiment, the means for admitting air into the first chamber include a duct for introducing air from the air pump.

More especially, the valve unit according to the invention may include a fourth chamber in the said casing, separated from the third chamber by a check valve, the means for evacuating air from the third chamber comprising the said check valve, the said fourth chamber, and the means for evacuating air from the said fourth chamber towards the exhaust manifold of the said engine.

In this embodiment, assembled in a single unit is the shut-off valve simplified according to the invention, as well as the check valve of prior art.

The check valve may notably include a substantially circular membrane fixed at its centre to a support pierced by openings and held against this support by an elastic leaf.

Figure 2:
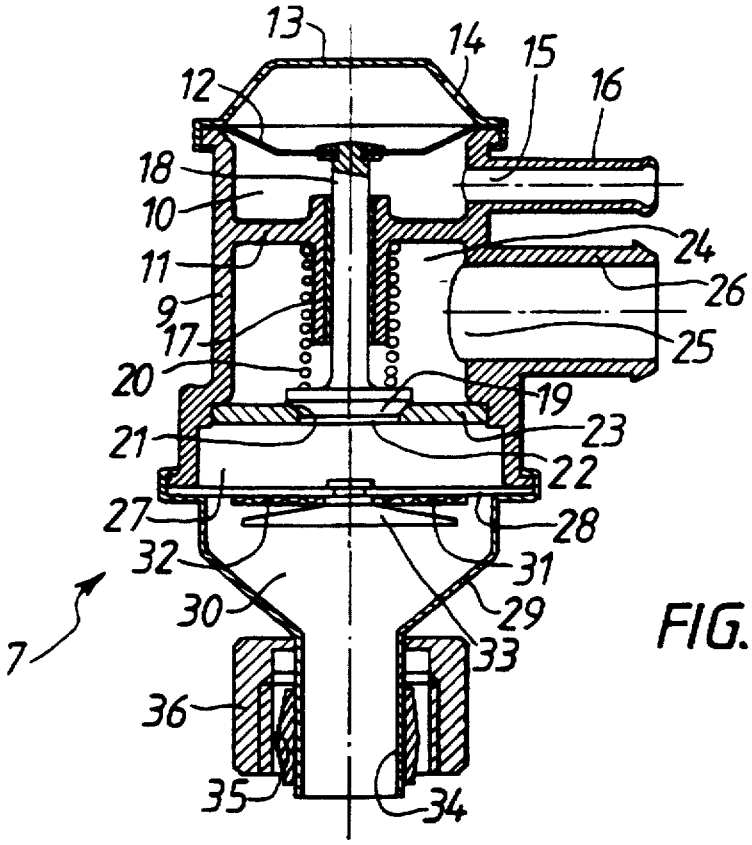
Figure 3:
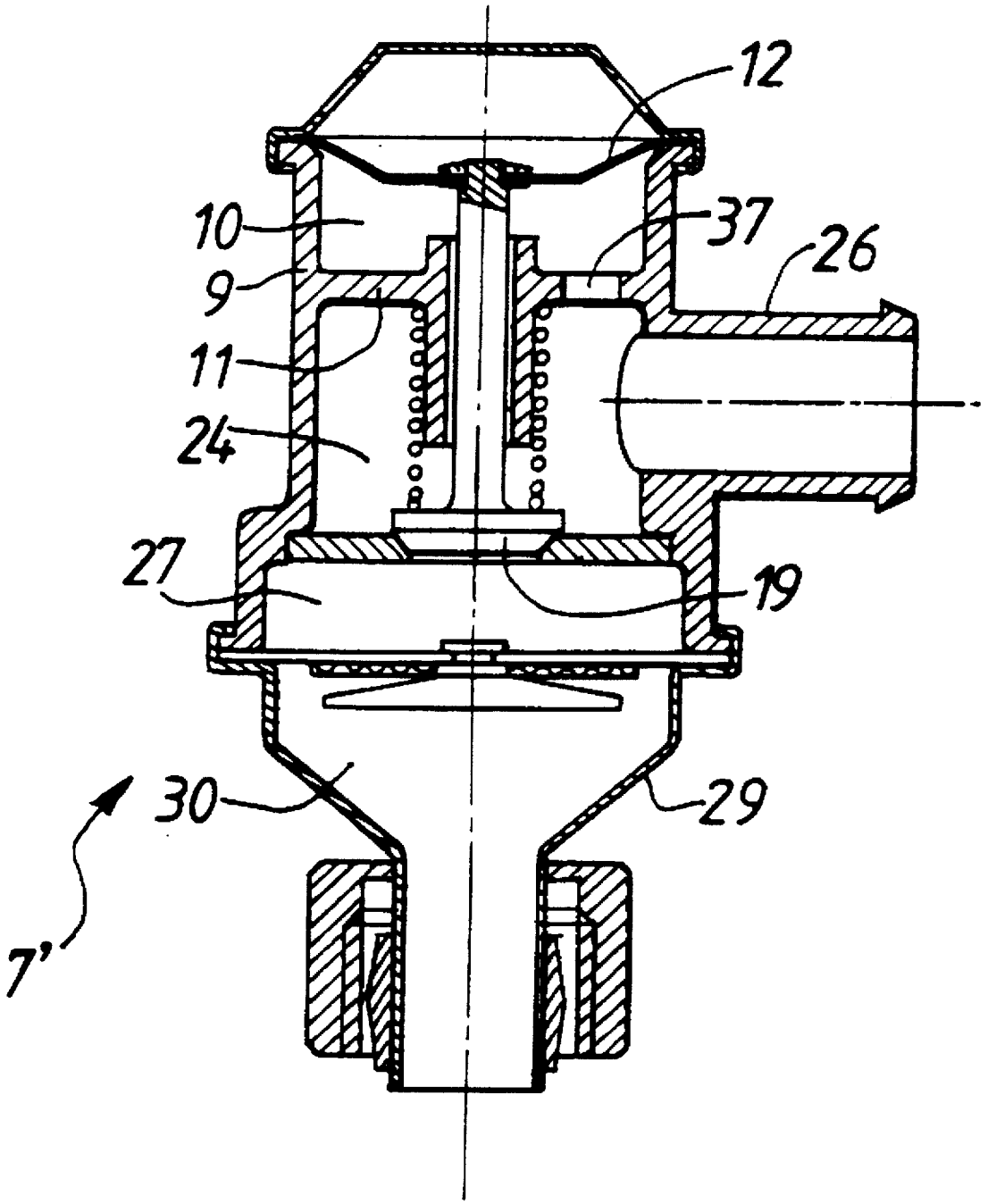
Figure 4:
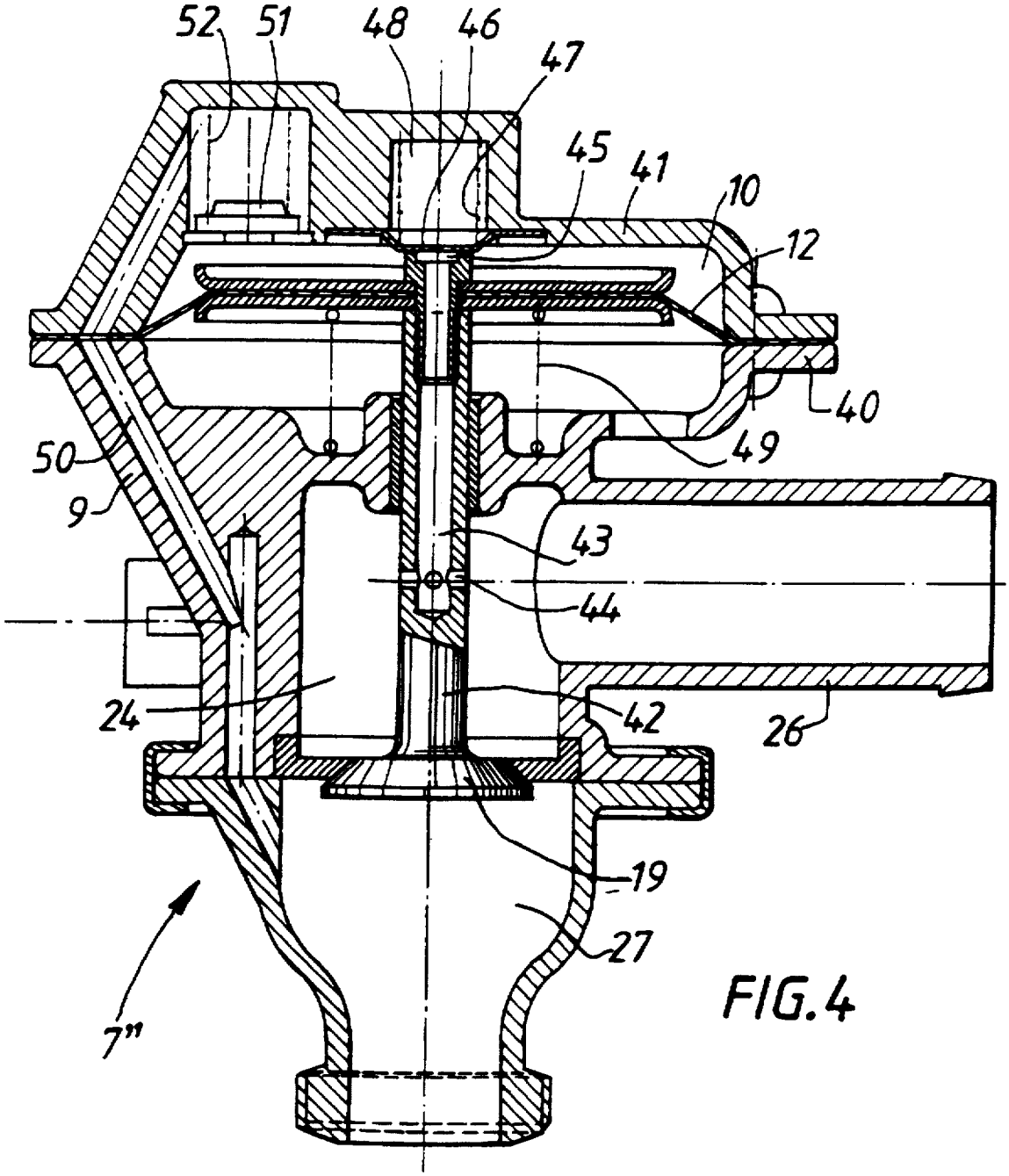

By way of non-limiting examples, particular embodiments of the invention will now be described, with reference being made to the appended drawings of which:

FIG. 1 represents a circuit for injecting air in the exhaust system including a valve according to the invention, FIG. 2 represents this valve in axial cross-section, FIG. 3 represents another embodiment, of this valve, and FIG. 4 represents another embodiment of this valve again.

FIG. 1 shows an air pump 1 driven by an electric motor 2. This pump receives external air via a duct 3, coming either from an independent air filter or from the main air inlet filter of the engine for which the circuit is intended.

The pump 1 sends the air, under pressure, along the duct 4. This duct 4 splits into two ducts 5 and 6, both of which are connected to the valve 7 according to the invention. The outlet of this valve is connected by a duct 8 to the air injection bank in the engine's exhaust manifold.

The valve 7, represented in cross-section in FIG. 2, comprises a valve body, or casing, 9 delimiting a plurality of chambers.

Firstly, a first chamber 10 is formed in the body 9 and delimited by a wall 11 and a membrane 12. The face of the membrane 12, outside the chamber 10, is protected by a cover 13, in which there are ventilation holes 14. An entry aperture 15 for the chamber 10 is formed by an entry duct 16, onto which the tube 5 may be fixed, by means of a collar for example.

In its central section, the wall 11 forms a guide tube 17 in which the rod 18 of a valve 19 may slide. At its opposite end to the valve 19, the rod 18 is fixed to the centre of the membrane 12. A helical spring 20, fitted around the guide tube 17 between the wall 11 and the valve 19, pushes the latter away from this wall.

The valve 19 cooperates with a valve seat 21, formed around an aperture 22, pierced in the centre of a disc 23, fixed by any appropriate means within the body 9. The disc 23 delimits with this body 9 and the wall 11 a second chamber 24. An inlet aperture 25 into the chamber 24 is connected to an inlet duct 26, onto which the duct 6 may be fixed, by means of a collar for example. The aperture 22 forms the outlet of the chamber 24.

The body 9 and the disc 23 delimit a third chamber 27 with a valve support 28. The support 28 is fixed to the lower section of the main body 9 by crimping of a secondary body 29 delimiting, with the support 28, a fourth chamber 30.

The fourth chamber 30 communicates with the third chamber 27, via a check valve, formed from the support 28 pierced with communicating holes, and supporting in its centre on the chamber 30 side, a rubber membrane 31, held against the communicating holes in the support 28 by a metallic elastic leaf 32. A cone 33, also attached to the central section of the support 28, makes it possible to limit the displacement of the membrane 31 and the spring 32. It is understood that air passing through the valve may pass from chamber 27 to chamber 30, and not from chamber 30 to chamber 27.

A duct 34 forms the chamber's outlet, and is fitted with an oval connector 35 and a nut 36, so that it can be connected to the connecting pipe 8 for the exhaust manifold.

When the engine 2 is started, the pump 1 sends air from it under pressure into ducts 5 and 6. The air sent into duct 5 gives rise to an increase in pressure in the chamber 10 and so to a deformation of the membrane 12 which moves to raise the valve 19 against the action of the spring 20.

The valve 19 being opened in this way, the air sent into the duct 6 is introduced into the chamber 24, then via the aperture 22 into the chamber 27. This air then passes through the check valve 31–33 and is sent into the chamber 30, and from there into the duct 8.

When operative, the valve 31–33 prevents exhaust gases from being sent from the duct 8 to the ducts 5 and 6.

When the engine ceases to receive its power supply, the pressure in the chamber 10 is returned to its normal level, so that the valve 19 closes, the valve 7 thus playing its part as a shut-off valve.

The valve 7' of the embodiment shown in FIG. 3 is practically identical to the valve 7, except for the fact that the chamber 10 no longer has an inlet aperture 15 and an inlet duct 16. This aperture is replaced by an aperture 37, formed in the wall 11, separating the first chamber 10 from the chamber 24.

Air coming from the pump 1 is then admitted into the chamber 10 via the tube 6, the duct 26, the chamber 24 and the aperture 37.

Apart from this difference, the valve 7' functions in an identical manner to the valve 7.

The valve 7" shown in FIG. 4 differs from the valves shown in FIGS. 2 and 3 basically in that the head and seat of the valve 19 separating the second and third chambers 24 and 27 respectively, are located in this third chamber 27. Thus this valve opens in the opposite direction to those previously described.

In this embodiment, a cavity is delimited between a flange 40 of the body 9 and a cover 41. The membrane 12 and this cover 41 delimit the first chamber 10 within this cavity.

The rod 42 of the valve is hollow so as to form a passage which can allow communication between the first chamber 10 and the second chamber 24. To this end, an axial duct 43 is formed within the rod 42 and issues into the chamber 24 via radial apertures 44 and into the chamber 10 via an axial aperture 45.

A second membrane 46 is held against the aperture 45 by a spring 47 set in a blind hole 48 in the cover 41. Furthermore, the membrane 12 and consequently the valve 19 to which it is attached and its aperture 45 are also urged toward the membrane 46 by a spring 49.

A set of bores 50 allows communication between the first chamber 10 and the third chamber 27. A check valve 51, set in the cover 41 and calibrated by a spring 52 prevents any leakage from the chamber 27 to the chamber 10.

The valve could just as well be set within the body of the casing.

As in the embodiment shown in FIG. 3, the pressure controlling the valve 19 is introduced into the chamber 10 via the chamber 27 and, in this case, the duct 43. When this pressure reaches a sufficient threshold, the membrane 46 allows it to enter the chamber 10. The membrane 12 then flexes downwards, opening the valve 19.

When the pressure falls in the chamber 27, the membrane 12 rises once more and so closes the valve 19, expelling into the chamber 27 a proportion of the air contained in the chamber 10, via the valve 51.

Conversely, the valve 51 prevents cyclical superpressures which occur in the exhaust manifold from rising into the chamber 10 and so disrupting the operation of the valve 19.

I claim:

1. A shut-off valve unit for an air injection circuit in an exhaust system of an internal combustion engine, the shut-off valve unit comprising;

a casing having a first chamber, a second chamber and a third chamber;

a membrane delimiting the first chamber in said casing;

means for admitting air into said first chamber from an air pump;

means for admitting air into said second chamber from said air pump;

means for evacuating air from said third chamber towards an exhaust manifold of said engine;

a valve including a valve rod controlled by said membrane to allow communication between said second chamber and said third chamber when said air pump is in operation;

wherein said means for admitting air into said first chamber includes a passage between said first and second chambers; and wherein said passage is formed in said valve rod.

2. A valve unit as claimed in claim 1, wherein the said passage issues axially into the first chamber, its aperture being, at rest, plugged by a plugging element which is acted upon by a spring.

3. A valve unit as claimed in claim 2, wherein the said plugging element includes a second membrane.

4. A valve unit as claimed in claim 1, wherein the said membrane is acted upon by a spring on its opposite face to that facing the said first chamber.

5. A valve unit as claimed in claim 1, wherein the said first chamber is connected to the said third chamber by an exhaust duct.

6. A valve unit as claimed in claim 5, wherein a calibrated check valve is fitted on the said exhaust duct.

7. A valve unit as claimed in claim 5, wherein the said exhaust duct is formed within the wall of the casing.

8. A valve unit as claimed in claim 1, wherein the said means for admitting air into the first chamber include a duct for introducing air from the air pump.

9. A valve unit as claimed in claim 1, comprising a fourth chamber in the said casing, separated from the third chamber by a check valve, the means for evacuating air from the third chamber comprising the said check valve, the said fourth chamber, and means for evacuating air from the said fourth chamber towards the exhaust manifold of the said engine.

10. A valve unit as claimed in claim 9, wherein the said check valve comprises a substantially circular membrane fixed at its centre to a support pierced by openings and held against this support by an elastic leaf.

* * * * *